US010753160B2

(12) United States Patent
Hiorth

(10) Patent No.: US 10,753,160 B2
(45) Date of Patent: Aug. 25, 2020

(54) WELL TOOL DEVICE

(71) Applicant: Interwell Technology AS, Ranheim (NO)

(72) Inventor: Espen Hiorth, Trondheim (NO)

(73) Assignee: Interwell Technology AS, Ranheim (NO)

( * ) Notice: Subject to any disclaimer, the term of this patent is extended or adjusted under 35 U.S.C. 154(b) by 131 days.

(21) Appl. No.: 16/072,576

(22) PCT Filed: Feb. 29, 2016

(86) PCT No.: PCT/EP2016/054197
§ 371 (c)(1),
(2) Date: Jul. 25, 2018

(87) PCT Pub. No.: WO2017/148497
PCT Pub. Date: Sep. 8, 2017

(65) Prior Publication Data
US 2019/0032424 A1 Jan. 31, 2019

(51) Int. Cl.
*E21B 17/07* (2006.01)
*E21B 17/046* (2006.01)
*E21B 17/03* (2006.01)

(52) U.S. Cl.
CPC ..... *E21B 17/073* (2013.01); *E21B 17/03* (2013.01); *E21B 17/046* (2013.01)

(58) Field of Classification Search
CPC ..... E21B 17/07; E21B 17/073; E21B 17/076; E21B 17/046; E21B 17/05; F16D 3/065; F16D 3/227; F16L 27/12; F16L 27/125
See application file for complete search history.

(56) References Cited

U.S. PATENT DOCUMENTS

| | | | |
|---|---|---|---|
| 6,494,495 | B1 | 12/2002 | Cunningham |
| 7,004,843 | B1 | 2/2006 | Kerstetter |
| 2010/0044113 | A1 | 2/2010 | Leblanc et al. |
| 2015/0028585 | A1 | 1/2015 | McLaughlin et al. |

OTHER PUBLICATIONS

International Search Report issued in PCT/EP2016/054197 dated Nov. 11, 2016 (5 pages).
Written Opinion of the International Searching Authority issued in PCT/EP2016/054197 dated Nov. 11, 2016 (6 pages).

*Primary Examiner* — D. Andrews
(74) *Attorney, Agent, or Firm* — Osha Liang LLP

(57) ABSTRACT

A well tool device may include a first subsection and a second subsection connected to each other. The first subsection comprises a first connector having an outwardly facing first connection interface and the second subsection comprises a second connector having an inwardly facing second connection interface, where the second connector is provided radially outside of the first connector. The first connection interface is facing towards the second connection interface. The first connection interface comprises a first recess provided in the first connector. The second connection interface comprises a second recess provided in the second connector. The first and second recesses together are forming a bolt compartment. The well tool device further comprises a locking bolt provided in the bolt compartment formed by the first and second recesses in order to connect the first and second subsections to each other. The bolt compartment formed by the first and second recesses has an opening in the outer surface of the second connector.

6 Claims, 5 Drawing Sheets

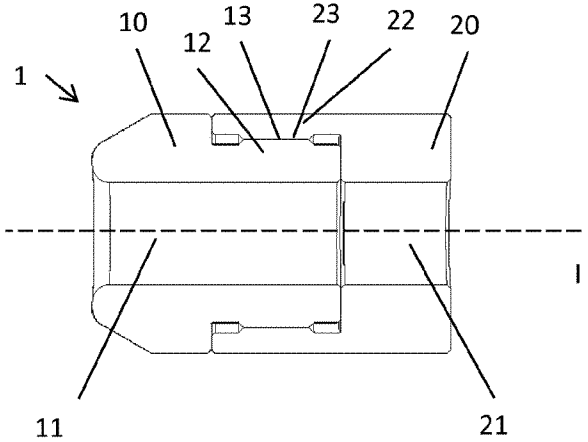
Fig. 1: prior art
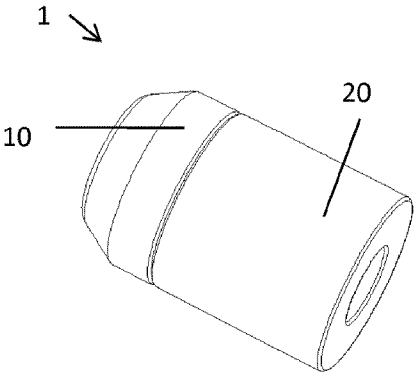
Fig. 2: prior art
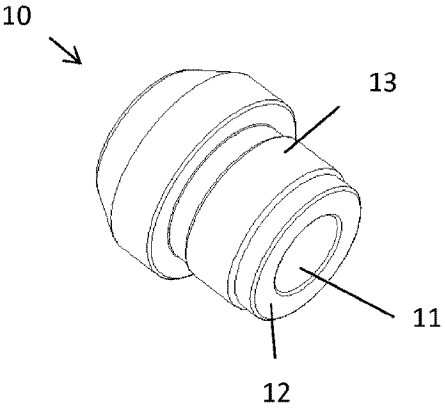
Fig. 3: prior art
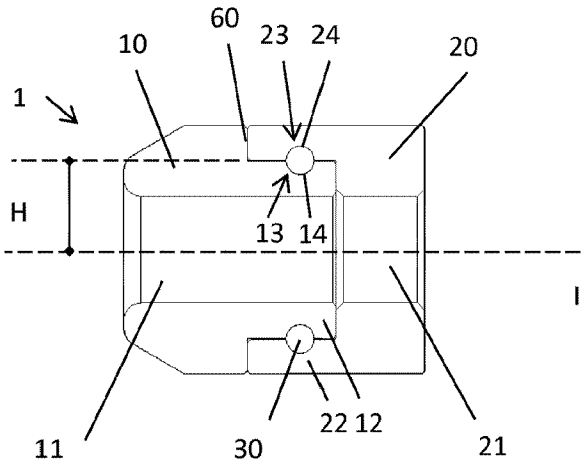
Fig. 4
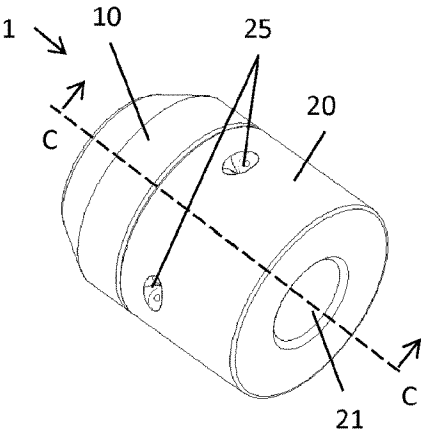
Fig. 5
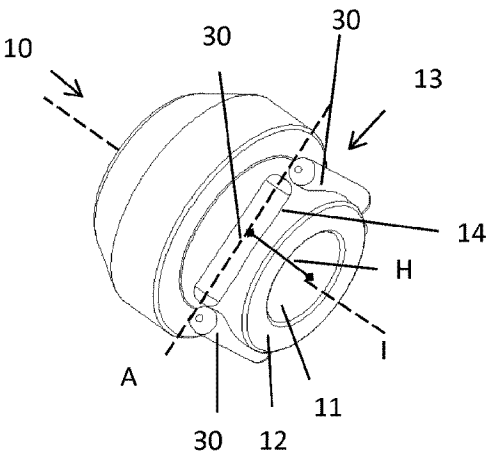
Fig. 6

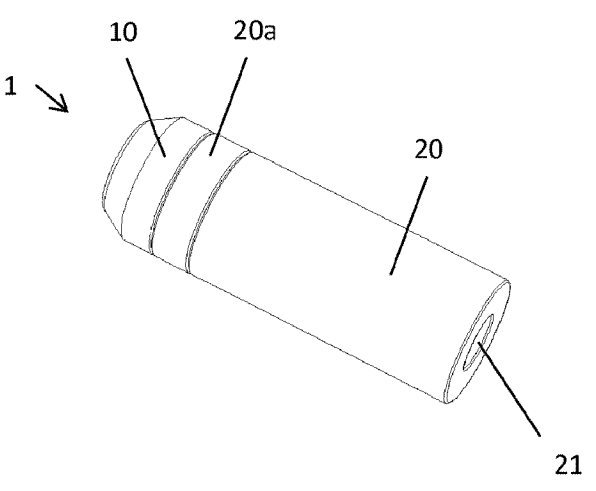
Fig. 8: prior art
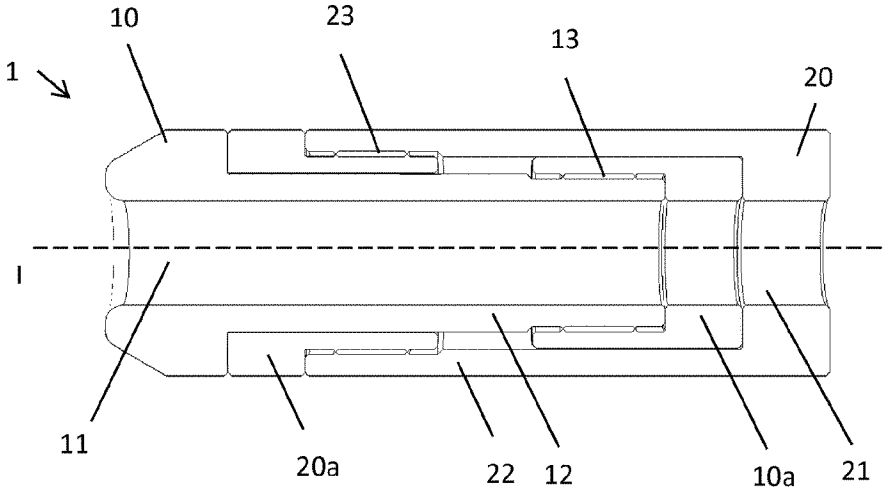
Fig. 7: prior art
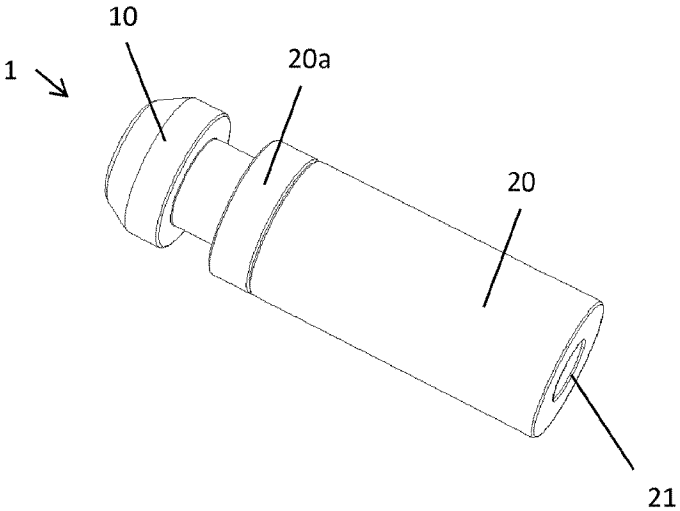
Fig. 10: prior art
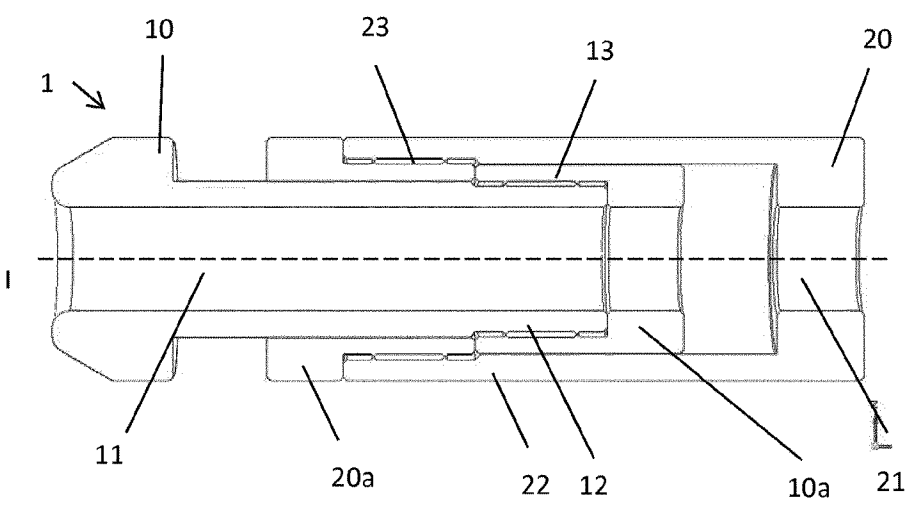
Fig. 9: prior art

WELL TOOL DEVICE

FIELD OF THE INVENTION

The present invention relates to a well tool device. In particular, the invention relates to a well tool device comprising a first subsection connected to a second subsection of the well tool device.

BACKGROUND OF THE INVENTION

Well tools, such as well barrier tools, packer tools, logging tools, perforation tools, pulling tools, retrieval tools etc. are commonly used in oil and/or gas wells to perform different types of operations. These well tools typically are cylindrical in their shape in order to be lowered into the well, and they comprise several parts or subsections that are assembled together. The common way of connecting these subsections to each other is by means of threaded connections.

Many such well tools are relatively long, which contributes to a higher material cost and a higher manufacturing cost (machining, milling etc). Moreover, it may be difficult or even impossible to run long well tools into narrow or curved wells. Hence, it is an object of the present invention to reduce the length of such well tools. A reduction of length will also make the handling of the tools easier, and possibly also the transportation costs may be reduced.

Well tools typically comprise many parts or subsections that are assembled into the well tools. The assembly operation is time consuming. Many such well tools are retrieved from the wells for future re-use. A full disassembly and re-assembly are required in order to achieve a reliable re-use. Hence, it is an object of the present invention to reduce the number of parts of such well tools and also to simplify the assembly and disassembly of such well tools.

In some tools, it may desired to achieve a small axial and/or relative rotation between subsections. In particular, relative rotation is difficult when using threaded connections, since the relative rotation may cause that the threaded connections becomes disconnected or partially disconnected. Hence, one object is to provide a well tool device where a small axial and/or relative rotation is possible without the risk of unintentional disconnection of the subsections from each other.

SUMMARY OF THE INVENTION

The above objects are achieved by a well plugging device according to the enclosed claims, with further details of the invention set forth in the description below.

DETAILED DESCRIPTION

Embodiments of the invention will now be described with reference to the enclosed drawings, where:

FIG. 1 illustrates a cross section of a prior art connection between two subsections of a well tool;

FIG. 2 illustrates a perspective view of the subsections of FIG. 1;

FIG. 3 illustrates corresponds to FIG. 2, but where the second subsection is removed;

FIG. 4 illustrates a cross section along line C-C in FIG. 5 of a first embodiment of the invention where two subsections of a well tool is connected to each other;

FIG. 5 illustrates a perspective view of the subsections of FIG. 4;

FIG. 6 illustrates corresponds to FIG. 5, but where the second subsection is removed;

FIG. 7 illustrates a cross section of a prior art connection between two subsections of a well tool in its first state, where the connection is flexible in the axial direction;

FIG. 8 illustrates a perspective view of the subsections of FIG. 7;

Figure 11:
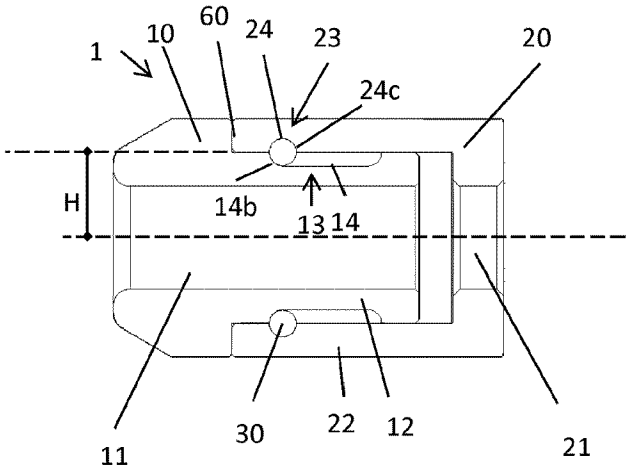
Figure 12:
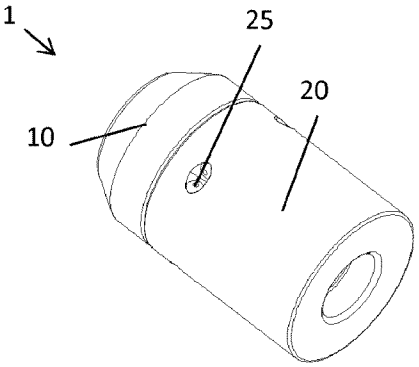
Figure 13:
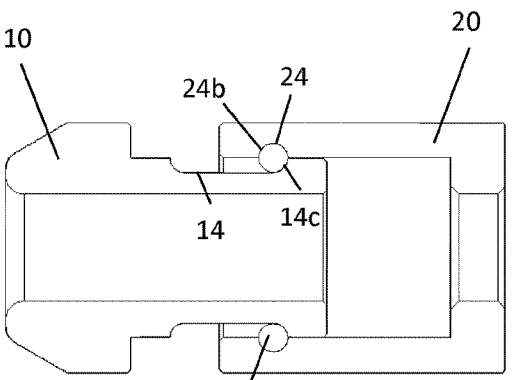
Figure 14:
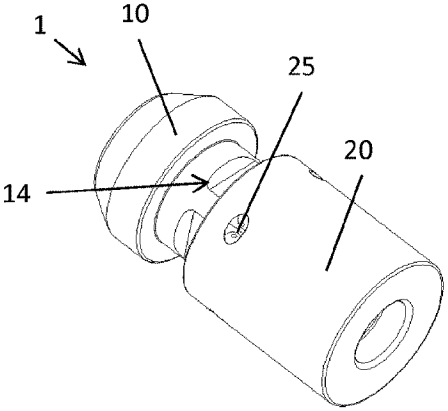
Figure 15:
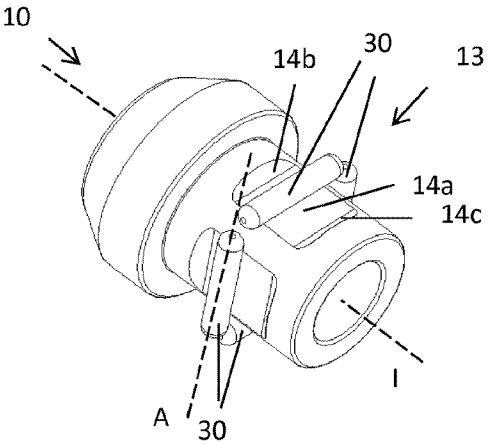
Figure 18:
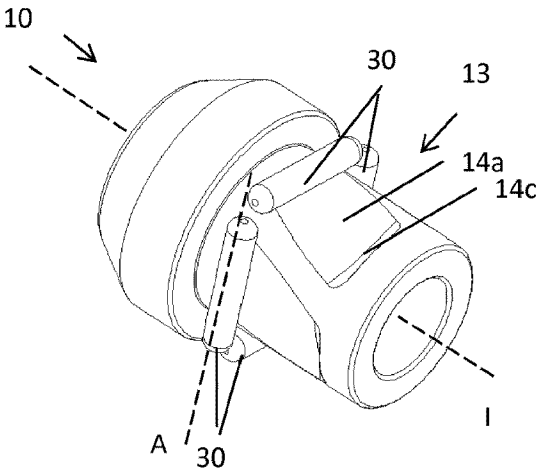
Figure 21:
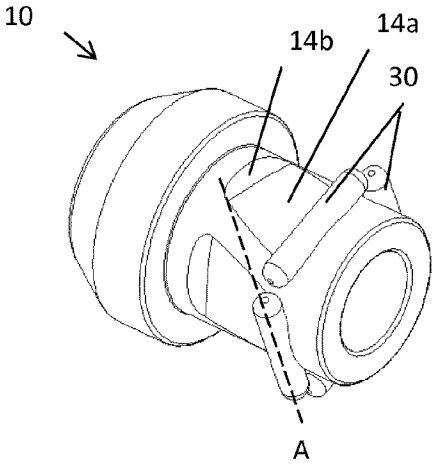
Figure 17:
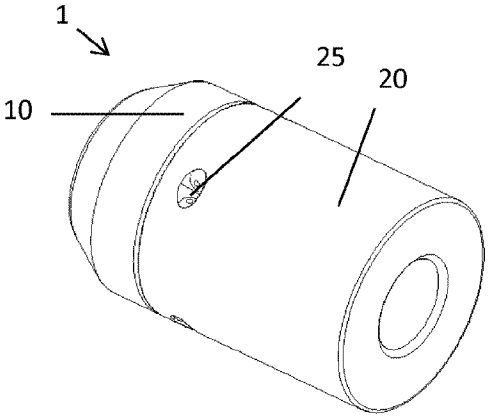
Figure 20:
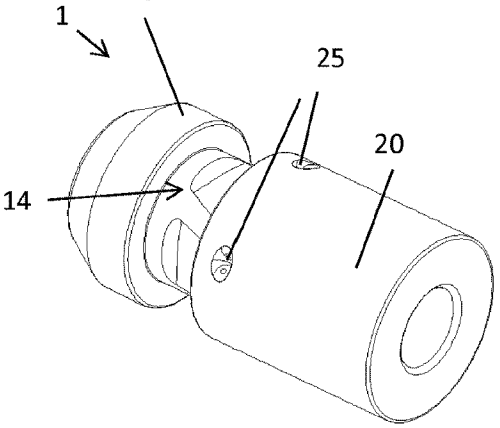
Figure 16:
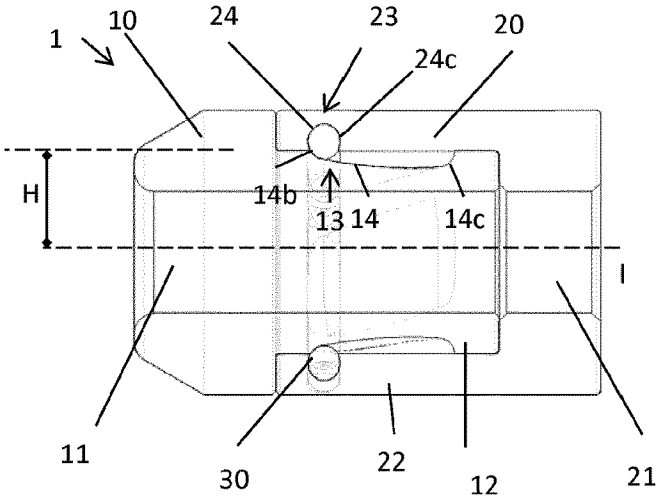
Figure 19:
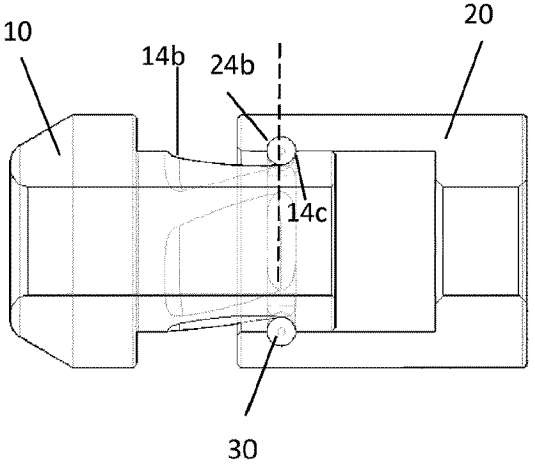
Figure 23:
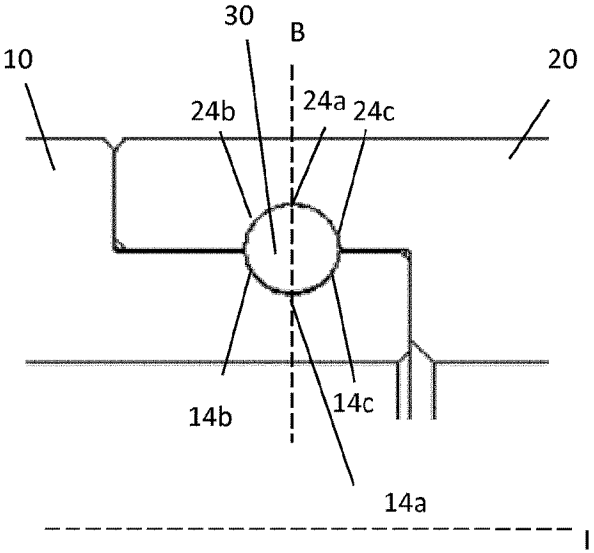
Figure 22:
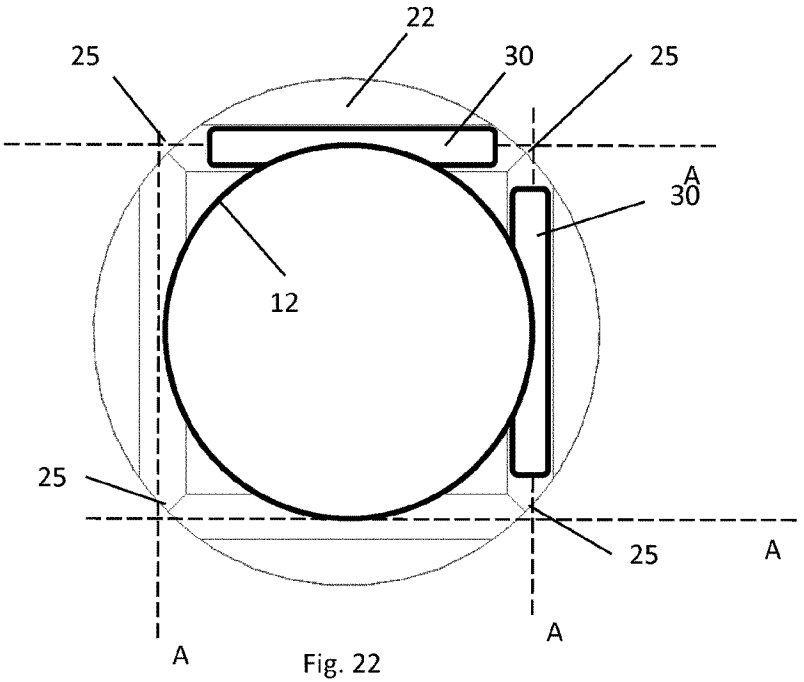

FIG. 9 corresponds to FIG. 7, but where the subsections have been displaced axially to its second state;

FIG. 10 illustrates a perspective view of the subsections of FIG. 9;

FIG. 11 illustrates a cross section of a second embodiment of the invention, where two subsections of a well tool is connected in its first state, where the connection is flexible in the axial direction;

FIG. 12 illustrates a perspective view of the subsections of FIG. 11;

FIG. 13 corresponds to FIG. 11, but where the subsections have been displaced axially to its second state;

FIG. 14 illustrates a perspective view of the subsections of FIG. 12;

FIG. 15 illustrates a perspective view of FIG. 12, where the second subsection has been removed;

FIG. 16 illustrates a cross section of a third embodiment of the invention, where two subsections of a well tool is connected in its first state, where the connection is flexible in the axial and rotational direction;

FIG. 17 illustrates a perspective view of the subsections of FIG. 16;

FIG. 18 illustrates a perspective view of FIG. 16, where the second subsection has been removed;

FIG. 19 illustrates a cross section of the third embodiment of the invention, where the two subsections of the well tool is connected in its second state, where the connection is flexible in the axial and rotational direction;

FIG. 20 illustrates a perspective view of the subsections of FIG. 19;

FIG. 21 illustrates a perspective view of FIG. 19, where the second subsection has been removed;

FIG. 22 illustrates a cross sectional view of the well tool device schematically;

FIG. 23 illustrates an enlarged view of the connection interfaces of FIG. 4.

Figure 24:
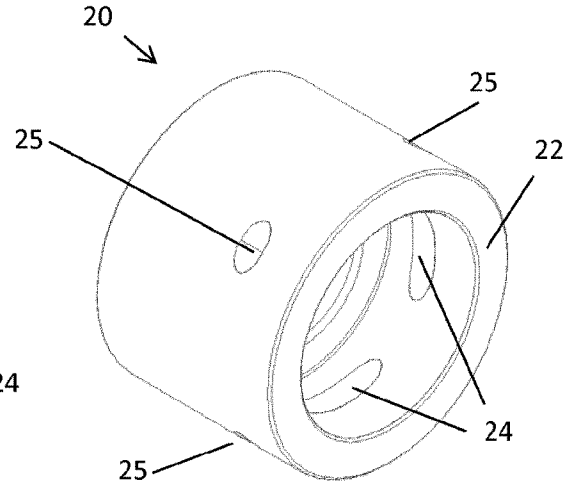

FIG. 24 illustrates a perspective view of the second subsection.

PRIOR ART OF FIGS. 1-3

It is now referred to FIGS. 1, 2 and 3, where it is shown a well tool device 1. The well tool device 1 is a part of a well tool, such as a plugging tool (for example a bridge plug), a packer tools (for example a straddle packer), a logging tool, a perforation tool etc.

It is shown here that the well tool device 1 comprises a first subsection 10 and a second subsection 20. The well tool device 1 is, similar to most well tools, substantially cylindrical. Each of the subsections 10, 12 have a through bore, 11, 21, parallel with or coinciding with the longitudinal axis I of the well tool device 1. A continuous bore through the well tool device 1 is hence formed by the bores 11, 21. It should be noted that the bores 11, 21 are not essential parts of the present invention.

In FIG. 1, it is shown that the first subsection 10 comprises a first connector 12 with an outwardly facing connection interface 13, while the second subsection 20 comprises a second connector 22 with an inwardly facing connection interface 23.

In FIGS. 1 and 2, it is shown that the first connector 12 is provided radially inside of the second connector 22, and that the first connection interface 13 is in contact with the second connection interface 23. In this prior art embodiment, the first and second connection interfaces 13, 23 comprises threads. Hence, the first connector 12 is connected to the second connector 22 by screwing the first subsection 10 together with the second subsection 20.

FIRST EMBODIMENT

It is now referred to FIG. 4-6. Similarly to the prior art described with reference to FIGS. 1-3 above, the well tool device 1 comprises a first subsection 10 and a second subsection 20 connected to each other. As indicated in FIG. 4, the first and second subsections 10, 20 have a longitudinal axis I. The well tool device 1 is also here substantially cylindrical. The first subsection 10 comprises a first connector 12 having an outwardly facing first connection interface 13, in FIGS. 4 and 6 it is shown that the connection interface 13 is protruding outwardly in a radial direction. The second subsection 20 comprises a second connector 22 having an inwardly facing second connection interface 23, in FIG. 4 it is shown that the connection interface 23 is protruding inwardly in a radial direction. The first connection interface 13 is facing towards the second connection interface 23. The second connector 22 is provided radially outside of the first connector 22.

In FIG. 4, and in the enlarged view of FIG. 23, it is shown that the first connection interface 13 comprises a first recess 14 provided in the first connector 12. The first recess 14 has a half-circular cross section with a bottom surface 14*a*, a first end surface 14*b* and a second end surface 14*c* as indicated in FIG. 23. In FIG. 23 it is shown that the bottom surface 14*a* is facing radially outwards (indicated by dashed line B) and away from the center axis I.

In FIG. 4, and in the enlarged view of FIG. 23, it is shown that the second connection interface 23 comprises a second recess 24 provided in the second connector 22. The second recess 24 also has a half-circular cross section with a bottom surface 24*a*, a first end surface 24*b* and a second end surface 24*c*. In FIG. 23 it is shown that the bottom surface 24*a* is facing radially inwards (indicated by dashed line B) towards the center axis I.

Hence, the first and second recesses 14, 24 together are forming a bolt compartment, in FIGS. 4 and 23 the bolt compartment is circular.

The well tool device 1 further comprises a locking bolt 30 provided in the bolt compartment formed by the first and second recesses 14, 24 in order to connect the first and second subsections 10 to each other. Since the first end surface 24*b* of the second recess 24 is facing towards the second end surface 14*c* of the first recess 14, and since the locking bolt 30 is provided in the compartment formed by the recesses 14, 24, it is not possible to pull the first and second subsections 10, 20 from each other. Moreover, since the second end surface 24*c* of the second recess 24 is facing towards the first end surface 14*b* of the first recess 14, and since the locking bolt 30 is provided in the compartment formed by the recesses 14, 24, it is not possible to push the first and second subsections 10, 20 towards each other.

It should be noted that in this embodiment the recesses do not have to be semicircular, they can be triangular or rectangular or polygonal. The locking bolt 30 could then have a shape adapted to fit into the bolt compartment formed by such recesses 14, 24.

However, the locking bolt is preferably cylindrical and has a circular cross section, and preferably, the bolt compartment is cylindrical.

In FIG. 5 it is shown that the bolt compartment formed by the first and second recesses 14, 24 has an opening 25 in the outer surface of the second connector 24.

In FIG. 6 it is shown that the well tool device 1 comprises locking bolts 30 and hence there are also four bolt compartments 30. This is also indicated schematically in FIG. 22, where the dashed lines indicate the compartments, and where one bolt is provided in each compartment.

In FIG. 22 it is also shown that the bolt compartment formed by the first and second recesses 14, 24 has two openings 25 in the outer surface of the second connector 24, one opening in each end of the bolt compartment. It is also shown that the opening 25 in the outer surface of the second connector 24 is one common opening 25 for two bolt compartments.

Hence, there are four openings for four bolt compartments, but still each compartment has two openings.

Of course it is possible to have less than four compartments and more than four compartments. It is also possible to have two individual openings per compartment, i.e. eight openings for four compartments.

In FIG. 22 it is shown that the longitudinal axis A of a first bolt compartment is different from the longitudinal axis A of the second, third and fourth bolt compartments.

It should be noted that in FIG. 22, only two of the locking bolts 30 are shown.

According to the above embodiment, an easy assembly process is achieved—the first connector 12 can be inserted into the second connector 22 and the bolts 30 can be inserted into the bolt compartments from the outside—no rotation between the subsections 10, 20 is required. Moreover, a nail punch or similar tool and a hammer can be used to punch the bolts out from the bolt compartments and thereafter the first and second subsections 10, 20 can be separated by pulling them in opposite directions.

It should also be noted that the length of the well tool device 1 in FIG. 4 is shorter than the well tool device 1 in FIG. 1, since no threaded connection interfaces are used in FIG. 4.

It should be noted that in FIGS. 4 and 6, it is shown that the bolt compartment formed by the first and second recesses 14, 24 has a longitudinal axis A provided at a distance H larger than zero from the longitudinal axis 1 of the well tool 1. The distance will typically be a few centimeters—dependent on the outer diameter of the well tool device 1.

The longitudinal axis A of the bolt compartment formed by the first and second recesses 14, 24 is perpendicular to the longitudinal axis I of the well tool 1.

As shown in FIG. 22, the well tool device 1 has a substantially circular cross section and the longitudinal axis A of the bolt compartment formed by the first and second recesses 14, 24 is provided as a chord through the well tool device 1.

In the embodiment shown in FIG. 4-6, axial and rotational movement between the first and second subsections 10, 20 are prevented.

The locking bolt may be a slotted tension pin, machined pins, dowel pins, hollow dowel pins, spring (slotted) dowel pins etc. It is also possible that the bolt is outwardly treaded, and that parts of the bolt compartment is inwardly threaded.

In case the locking bolt is a slotted tension pin, it is possible to insert an outer pin adapted to be inserted into the bolt compartment, and then insert an inner pin into the opening of the outer pin in order to achieve an even stronger bolt.

PRIOR ART OF FIGS. 7-10

It is now referred to FIGS. 7-10, where a prior art well tool device 1 is illustrated. Here, the well tool device 1 comprises a first subsection 10, a second subsection 20 a third subsection 10*a* connected to the first subsection 10 via a first, threaded connection interface 13 and a fourth subsection 20*a* connected to the second subsection 20 via a second, threaded connection interface 23. Hence, here four subsections are used, and two different threaded connections are used.

In FIG. 9, it is shown that the first and third subsections 10, 10*a* have been moved axially in relation to the second and fourth subsections 20, 20*a*. The axial movement is limited by the subsections 10*a*, 20*a* having a diameter sufficiently large to prevent movement of subsection 10*a* through the opening in the subsection 20*a*.

Such axial displacements are commonly used in well tools in order to release tension in springs, for example during setting or releasing of an anchoring device, setting or releasing of a sealing or packer device, during setting or releasing of a sealing backup device, an equalizing mechanism for such tools etc.

SECOND EMBODIMENT—FIGS. 11-15

It is now referred to FIGS. 11-15, where a second embodiment of the well tool device 1 is shown. The second embodiment has many common features with the first embodiment. Those common features have the same reference numbers as above and a description of them will not be repeated here.

The length of the second subsection 20 in FIGS. 13 and 14 is longer than the length of the second subsection 20 of the first embodiment of FIG. 4. It should be noted that the recess 24 of the second subsection 20 is here identical to the one of the first embodiment shown in FIG. 23.

In the second embodiment, the first recess 14 still has the bottom surface 14*a*, the first end surface 14*b* and the second end surface 14*c*. Moreover, the function of the first and second end surfaces 14*b*, 14*c* is to limit relative axial movement of the first and second subsections 10, 20. In FIGS. 11 and 13, it can be seen that the cross section of the first recess 14 is generally U-shaped.

In the second embodiment, the bottom surface 14*a* is forming a sliding surface (hereinafter also referred to with reference number 14*a*). Here, the locking bolt 30 is configured to slide or roll on the sliding surface 14*a* between the first end surface 14*b* and the second end surface 14*c*. Consequently, relative movement is allowed between the first and second subsections 10, 20.

In FIGS. 11 and 12, a first or axially retracted position is shown. Here, the second end surface 24*c* of the second recess 24 is facing towards the first end surface 14*b* of the first recess 14. As the locking bolt 30 is provided in the compartment formed by the recesses 14, 24, it is not possible to push the first and second subsections 10, 20 further towards each other. An additional contact surface indicated by reference number 60 between the first and second subsections 10, 20 is also preventing such movement.

In FIGS. 13 and 14, a second or axially expanded position is shown. Here, the first end surface 24*b* of the second recess 24 is facing towards the second end surface 14*c* of the first recess 14. As the locking bolt 30 is provided in the compartment formed by the recesses 14, 24, it is not possible to pull the first and second subsections 10, 20 further axially away from each other.

In FIGS. 11, 13 and 15, the sliding surface 14*a* is a planar surface in order to allow relative axial movement between the first and second subsections 10, 20.

When compared to prior art FIGS. 7 to 10, it is clear that second embodiment has fewer parts and has a shorter length.

Also in this embodiment, the locking bolt is preferably cylindrical and has a circular cross section. This will allow the locking bolt to roll on the sliding surface 14*a*.

THIRD EMBODIMENT—FIGS. 16-21

It is now referred to FIGS. 16-21, where a third embodiment of the well tool device 1 is shown. The third embodiment has many common features with the first and second embodiment. Those common features have the same reference numbers as above and a description of them will not be repeated here.

The length of the second subsection 20 in FIGS. 13 and 14 is longer than the length of the second subsection 20 of the first embodiment of FIG. 4. It should be noted that the recess 24 of the second subsection 20 is here identical to the one of the first embodiment shown in FIG. 23.

In the second embodiment, the first recess 14 still has the bottom surface 14*a*, the first end surface 14*b* and the second end surface 14*c*. Moreover, the function of the first and second end surfaces 14*b*, 14*c* is to limit relative axial movement of the first and second subsections 10, 20. In FIGS. 11 and 13, it can be seen that the cross section of the first recess 14 is generally U-shaped.

In the third embodiment, the sliding surface 14*a* is a helical surface, as indicated in FIGS. 18 and 21 (also here referred to with reference number 14*a*). As in the second embodiment, the locking bolt 30 is configured to slide or roll on the sliding surface 14*a* between the first end surface 14*b* and the second end surface 14*c*. Consequently, relative axial and rotational movement is allowed between the first and second subsections 10, 20.

In FIGS. 16, 17 and 18, a first or axially retracted position is shown. Here, the second end surface 24*c* of the second recess 24 is facing towards the first end surface 14*b* of the first recess 14. As the locking bolt 30 is provided in the compartment formed by the recesses 14, 24, it is not possible to push the first and second subsections 10, 20 further towards each other. An additional contact surface indicated by reference number 60 between the first and second subsections 10, 20 is also preventing such movement.

In FIG. 13, a second or axially expanded position is shown. Here, the first end surface 24*b* of the second recess 24 is facing towards the second end surface 14*c* of the first recess 14. As the locking bolt 30 is provided in the compartment formed by the recesses 14, 24, it is not possible to pull the first and second subsections 10, 20 further axially away from each other.

Also in this embodiment, the locking bolt is preferably cylindrical and has a circular cross section.

As mentioned above, such axial and rotational displacements are commonly used in different types of well tools.

The invention claimed is:

1. A well tool device for use in an oil and/or gas well, comprising:

a first subsection and a second subsection connected to each other, wherein the first and second subsection have a longitudinal axis;

wherein the first subsection comprises a first connector having an outwardly facing first connection interface;

wherein the second subsection comprises a second connector having an inwardly facing second connection interface;

wherein the second connector is provided radially outside of the first connector;

wherein the first connection interface is facing towards the second connection interface;

wherein the first connection interface comprises a first recess provided in the first connector;

wherein the second connection interface comprises a second recess provided in the second connector;

wherein the first and second recesses together are forming a bolt compartment;

wherein the well tool device further comprises a locking bolt provided in the bolt compartment formed by the first and second recesses in order to connect the first and second subsections to each other;

wherein the bolt compartment formed by the first and second recesses has two openings in the outer surface of the second connector and one of the two openings in each end of the bolt compartment;

wherein the first or second recess has a bottom surface forming a sliding surface, a first end surface and a second end surface, wherein the locking bolt is configured to slide or roll on the sliding surface between the first end surface and the second end surface in order to allow relative movement between the first and second subsections; and wherein the sliding surface is a helical surface configured to allow axial and rotational movement between the first and second subsections.

2. The well tool device according to claim 1, wherein the bolt compartment formed by the first and second recesses has a longitudinal axis provided at a distance larger than zero from the longitudinal axis of the first and second subsection.

3. The well tool device according to claim 2, wherein the longitudinal axis of the bolt compartment formed by the first and second recesses is perpendicular to the longitudinal axis of the first and second subsection.

4. The well tool device according to claim 2, wherein the well tool device has a circular cross section and wherein the longitudinal axis of the bolt compartment formed by the first and second recesses is provided as a chord through the well tool device.

5. The well tool device according to claim 1, further comprises:

at least one more bolt compartment, each bolt compartment having a longitudinal axis; and one locking bolt in each bolt compartment, wherein the longitudinal axis of a first bolt compartment is different from the longitudinal axis of a second bolt compartment, wherein the first bolt compartment is selected among the bolt compartment or the at least one more bolt compartment, and the second bolt compartment is selected among the bolt compartment or the at least one more bolt compartment, wherein each at least one more bolt compartment is formed by the respective first recess provided in the first connector and by the respective second recess provided in the second connector, wherein each at least one more bolt compartment has two openings in the outer surface of the second connector, one opening in each end of the bolt compartment, wherein the respective first recess or the respective second recess of each at least one more bolt compartment has a bottom surface forming a sliding surface, a first end surface and a second end surface, wherein said one locking bolt in the respective bolt compartment of the at least one more bolt compartment is configured to slide or roll on the sliding surface between the first end surface and the second end surface of the respective bolt compartment of the at least one more bolt compartment to allow relative movement between the first and second subsections, and wherein the sliding surface of each at least one more bolt compartment is a helical surface configured to allow relative axial and rotational movement between the first and second subsections.

6. The well tool device according to claim 5, wherein one opening in the outer surface of the second connector is a common opening for the bolt compartment and another bolt compartment.

* * * * *